US005875847A

United States Patent [19]

Forsyth

[11] Patent Number: 5,875,847

[45] Date of Patent: Mar. 2, 1999

[54] MULTILATERAL SEALING

[75] Inventor: David G. Forsyth, Bucksburn, Scotland

[73] Assignee: Baker Hughes Incorporated, Houston, Tex.

[21] Appl. No.: 897,929

[22] Filed: Jul. 21, 1997

[30] Foreign Application Priority Data

Jul. 22, 1996 [GB] United Kingdom ..... 9615355

[51] Int. Cl.[6] ..... E21B 43/14

[52] U.S. Cl. ..... 166/313; 166/50

[58] Field of Search ..... 166/50, 52, 313, 166/366, 243, 341, 342, 349, 382

[56] References Cited

U.S. PATENT DOCUMENTS

| | | | |
|---|---|---|---|
| 2,492,079 | 12/1949 | Wiley . | |
| 3,884,298 | 5/1975 | Watkins | 166/351 |
| 4,077,472 | 3/1978 | Gano | 166/382 |
| 4,133,378 | 1/1979 | Gano | 166/360 |
| 4,154,298 | 5/1979 | Gano | 166/85.5 |
| 4,304,310 | 12/1981 | Garrett | 175/195 |
| 5,330,007 | 7/1994 | Collins et al. . | |
| 5,655,602 | 8/1997 | Collins . | |
| 5,680,901 | 10/1997 | Gardes . | |
| 5,685,373 | 11/1997 | Collins et al. . | |

FOREIGN PATENT DOCUMENTS

| | | |
|---|---|---|
| 2282835 | 4/1995 | United Kingdom . |
| 2295840 | 6/1996 | United Kingdom . |

*Primary Examiner*—Frank Tsay
*Attorney, Agent, or Firm*—Fishman, Dionne, Cantor & Colburn

[57] ABSTRACT

The invention comprises a casing tool having a lateral root premachined therein and plugged with cement. A wear bushing is also positioned within the entrance to the root from the uphole side of the tool to prevent distortion or even destruction of the root while the lateral is being drilled. Subsequent to the lateral being drilled the wear bushing is removed and a liner is run which is then sealed to the bore of the root with conventional sealing techniques, thus avoiding the need to seal oval holes.

7 Claims, 2 Drawing Sheets

MULTILATERAL SEALING

BACKGROUND OF THE INVENTION

1. Filed of the Invention

This invention relates generally to the completion of junctions between primary and lateral wellbores. More particularly, this invention relates to new and improved methods and devices for sealing the junction of a branch wellbore extending laterally from a primary well which may be vertical, substantially vertical, inclined or even horizontal. This invention finds particular utility in the sealing of junctions of multilateral wells, that is, downhole well environments where a plurality of discrete, spaced lateral wells extend from a common primary wellbore.

2. Prior Art

Lateral well drilling and production have been increasingly important to the oil industry in recent years. While lateral wells have been known for many years, only relatively recently have such wells been determined to be a cost effective alternative (or at least companion) to conventional well drilling. Although drilling a lateral well costs substantially more than its vertical alternative, a lateral well frequently improves well productivity by several fold. Lateral drilling provides the means for enhancing field economics by accessing and developing reservoirs that would otherwise be uneconomic to develop using conventional drilling and completion practices. Hydrocarbon reservoirs that are ideal candidates for lateral technology are those that are thin and limited in size, multi faulted, or naturally fractured. Other reasons for employing laterals are to address reservoir vertical conformance, oil and gas coning potential and sweep efficiency. Environmental issues, such as the number of drilling sites in sensitive areas can also be addressed with lateral technology. In addition, improved field development economics can be achieved in large reservoirs using multiple laterals by improving the productivity of individual wells thereby reducing investment and operational costs.

Some wells contain additional wellbores extending laterally from the lateral. These additional lateral wells are sometimes referred to as drain holes and primary wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of lateral wells, lateral well completion, and particularly multilateral well completion have posed important concerns and have provided (and continue to provide) a host of difficult problems to overcome. Lateral completion, particularly at the juncture between the primary and lateral wellbore is extremely important in order to avoid collapse of the well in unconsolidated or poorly consolidated formations. Thus, open hole completions are limited to competent rock formations; and even then, open hole completions are inadequate in many cases since there is limited control or ability to re-access (or re-enter) the lateral or to isolate production zones within the well. Coupled with this need to complete lateral wells is the growing desire to maintain the size of the wellbore in the lateral well as close as possible to the size of the primary wellbore for ease of drilling and completion.

Conventionally, lateral wells have been completed using either slotted liner completion, external casing packers (ECP's) or cementing techniques. The primary purpose of inserting a slotted liner in a lateral well is to guard against hole collapse. Additionally, a liner provides a convenient path to insert various tools such as coiled tubing in a lateral well. Three types of liners have been used: (1) perforated liners, where holes are drilled in the liner, (2) slotted liners, where slots of various width and depth are milled or wire wrapped along the liner length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a lateral well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long lateral well bore into several small sections. This method provides limited zone isolation, which can be used for stimulation or production control along the well length. However, ECP's are also associated with certain drawbacks and deficiencies. For example, normal lateral wells have many bends and curves. In a hole with several bends it may be difficult to insert a liner with several external casing packers.

Finally, it is possible to cement and perforate medium and long radius wells, as shown, for example, in U.S. Pat. No. 4,436,165.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple lateral wells. U.S. Pat. No. 5,318,122, which is assigned to the assignee hereof and incorporated herein by reference, discloses deformable devices that selectively seal the juncture between the primary and lateral wells using an inflatable mold which utilizes a hardenable liquid to form a seal, expandable memory metal devices or other devices for plastically deforming a sealing material. U.S. Pat. Nos. 4,396,075; 4,415,205; 4,444,276 and 4,573,541 all relate generally to methods and devices for multilateral completion using a template or tube guide head. Other patents and patent applications of general interest in the field of lateral well completion include U.S. Pat. Nos. 2,452,920, 4,402,551, 5,289,876, 5,301,760, 5,337,808, Australian patent application 40168/93, U.S. application Ser. No. 08/306,497 filed Sep. 15, 1994 which is assigned to the assignee hereof and incorporated herein by reference, and U.S. Ser. No. 08/188,998 filed Jan. 26, 1994, now U.S. Pat. No. 5,474,131 which is also commonly assigned and incorporated herein by reference.

Notwithstanding the above-described attempts at obtaining cost effective and workable lateral well completions, there continues to be a need for new and improved methods and devices for providing such completions, particularly sealing between the juncture of primary and lateral wells, the ability to re-enter lateral wells (particularly in multilateral systems) and achieving zone isolation between respective lateral wells in a multilateral well system.

Some of the most recent developments include the following: one method for cementing the junction between the main borehole and the lateral borehole addresses the issue of creating a window in the main (or primary) hole, drilling a lateral wellbore and then sealing the juncture between the lateral and primary wellbores to have the ability to re-enter each lateral wellbore as well as to maintain the option to perform any function that could be done in a single wellbore. For this reason, cemented lateral wellbores are desirable so that normal isolation, stimulation or any other operation can be achieved.

In accordance with this prior art method, prior to running in a novel "hook" liner system described hereinafter, a standard whipstock is used to mill out a window in the side of the casing of the primary wellbore at the location where it is desired to drill a lateral wellbore.

In accordance with this prior art method, prior to running in a hook hanger system (fully described in U.S. Pat. No. 5,477,925, and briefly described hereinafter) a standard whipstock is used to mill a window in the side of the casing of the primary wellbore at the location where it is desired to drill a lateral wellbore.

The hook liner hanger is run on top of the lateral liner. The liner is run into the main casing and then out through the aforementioned milled window. The hook liner hanger has a pre-machined window, a hook system, and a re-entry system. When the hook on the hanger locates on the main casing milled window, it orients the hanger, so that the pre-machined window is aligned with the lower part of the main casing below the milled window. The running system for the hook liner hanger, includes a method of isolating the pre-machined window from the bore of the hook liner hanger. If desired the liner can be cemented in place, using standard cementing techniques commonly used in regular liner placements. The hook liner hanger can be run in various combinations to suit the needs of the wellbore. These combinations can include equipment such as external casing packers, sand control screens, partially cemented liner, fully cemented liner, and liner hanger packers.

When the hook hanger is to be cemented in place, a tube is attached to the lower end of the liner hanger running tool that extends below the pre-machined window. The annular space between the tube and the Liner Hanger body is sealed, so that the cement does not circulate back through the pre-machined window. After the cement has been pumped in place, the tube can be pulled back above the pre-machined window and then diverted back down through the pre-machined window to clean out the flow path back to the main casing below the milled window.

A variation of the hook liner hanger is a version where the formation can be hydraulically sealed from the lateral liner, the lower main casing and the upper main casing. A short section of casing extends from the periphery of the pre-machined window in the hook liner hanger. The end of this section is cut obliquely so that when being run it is possible to run inside the main wellbore casing, yet when landed will still extend from the hook liner hanger. After the hook liner hanger is fully positioned and any cementing has taken place, a tie back assembly is employed which will go through the pre-machined window in the hook liner hanger and land in the packer positioned below the window which was initially positioned for the whipstock. When the anchor lands in the packer it will orient in the same manner as the whipstock did. The orientation will also align a seal system which will land in the short section of casing extending from the hook liner hanger. The seal system can be of any of the common types such as a packing element, chevron seal system, or an interference seal system.

The "hook" liner hanger system includes a "hook" and is run into the wellbore and then through the aforementioned milled window. The "hook" liner hanger system is run into the lateral wellbore until the "hook" hanger locates on the milled window in the main primary wellbore. Inside the "hook" liner hanger system is a tail pipe assembly with adjustable opposing swab cups. The tail pipe assembly carries liquid cement or other fluids as required to inflate external casing packers or other devices as required. The end of the "hook" hanger liner is then plugged to allow the hydraulic set hanger to set by means of applied pressure. An external casing packer located near the end of the "hook" liner hanger system is then inflated to seal the lateral wellbore annular space just below the cementing valve of the "hook" liner hanger system. Opposing "swabcups" are used to direct fluid to inflate the external casing packer.

The tailpipe assembly string is then withdrawn high enough to allow the end of the tailpipe assembly string to be pulled from the lateral wellbore and then lowered into the main wellbore through the premilled window of the "hook" liner hanger system to assist in reducing debris from falling into the main wellbore. While the system does create a good sealed junction it is a difficult process and an easier and more speedy process is always desirable.

U.S. Pat. No. 5,318,122 discloses a number of embodiments employing differing forms and hardenable filling materials. The methods include employing 1) an inflatable mold which utilizes a hardenable liquid like epoxy or cement; 2) expandable memory metal devices; 3) swaging devices for plastically deforming a sealing material; 4)liner seals for sealing between the liner and the primary bore; and 5) side pocket devices to guide a liner into the lateral.

All of the prior art devices and methods while performing well for their intended functions are still in need of improvement. A particular area of improvement desired is in the cement at the junction which in present art is employed as both the junction and the seal. This works marginally well and is subject to failure due to limitations in the cement material itself or the ability to place the cement successfully at the junction. More particularly, under the conditions downhole, cement can fail by deteriorating to such an extent that the seal begins to leak thus contaminating the production. Therefore it is desirable to provide alternate junction creating and sealing arrangements which may be more reliable and improved performance under downhole conditions.

SUMMARY OF THE INVENTION

The above-discussed and other drawbacks and deficiencies of the prior art are overcome or alleviated by the preformed lateral junction of the invention.

In order to avoid the need for cementing a junction as the only seal, the invention employs a side pocket type casing segment run as part of the original main bore casing string. As many side pocket segments will be positioned as laterals are desired within the main bore casing string. It is noted, however, that a twenty-one inch O.D. is preferred for this side pocket device and, therefore, a large borehole would be necessary. A benefit of the large size is that, referring to the drawings, the upper and lower cross-section of the casing segment of the invention may be a full 9 ⅝ diameter casing allowing conventional tools to be passed through the junction segment. The segment itself provides a main bore and an angled lateral bore, the lateral being plugged with cement and provided with a wear bushing at the uphole end thereof. The main borehole section of the side pocket device is provided with a selective profile which will subsequently be employed to anchor and orient a whipstock to divert a subsequently run drillstring into the side pocket lateral root for drilling out the cement plug and drilling the lateral. The drill string will be deflected into the lateral wear bushing and will drill through the cement plug and out into the formation. Once drilling is complete, the drill string is removed, the wear bushing is removed and a liner running tool is run to place a liner in the lateral bore where the liner may be sealed by a conventional packing element on a cylindrical bore as opposed to an oval window. Greater sealing efficiency and superior ease of sealing is realized by the device of the invention.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
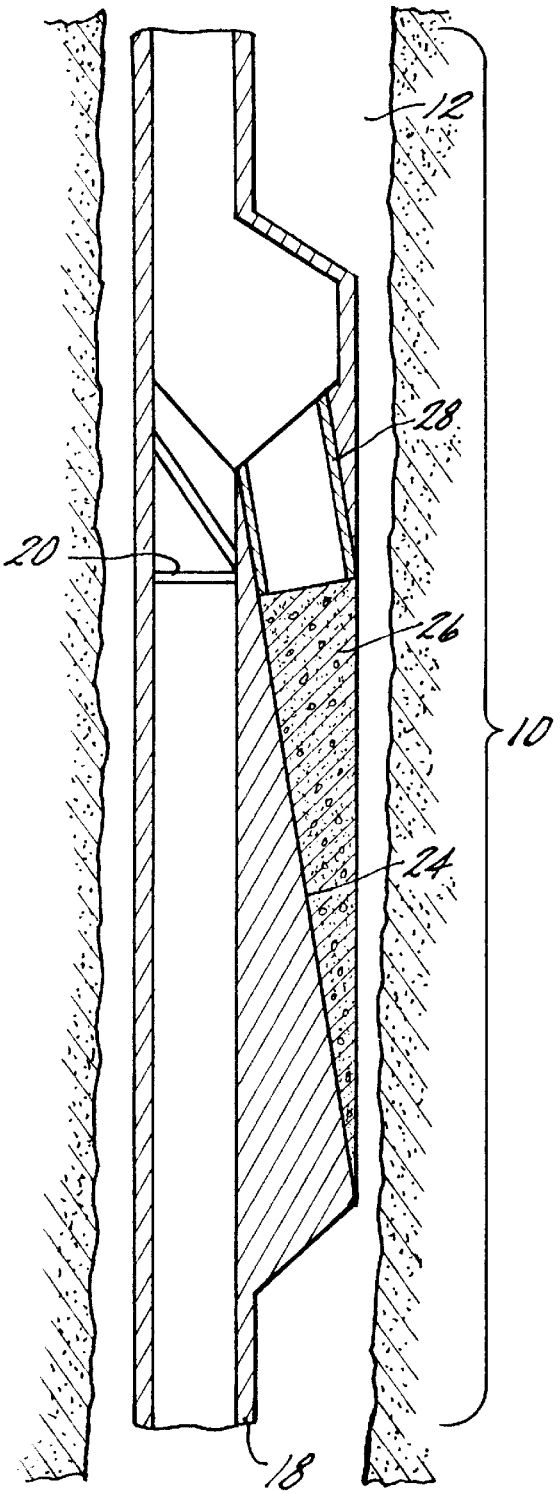
FIG. 1 is a cross-section illustration within the borehole and cemented therein.
Figure 2:
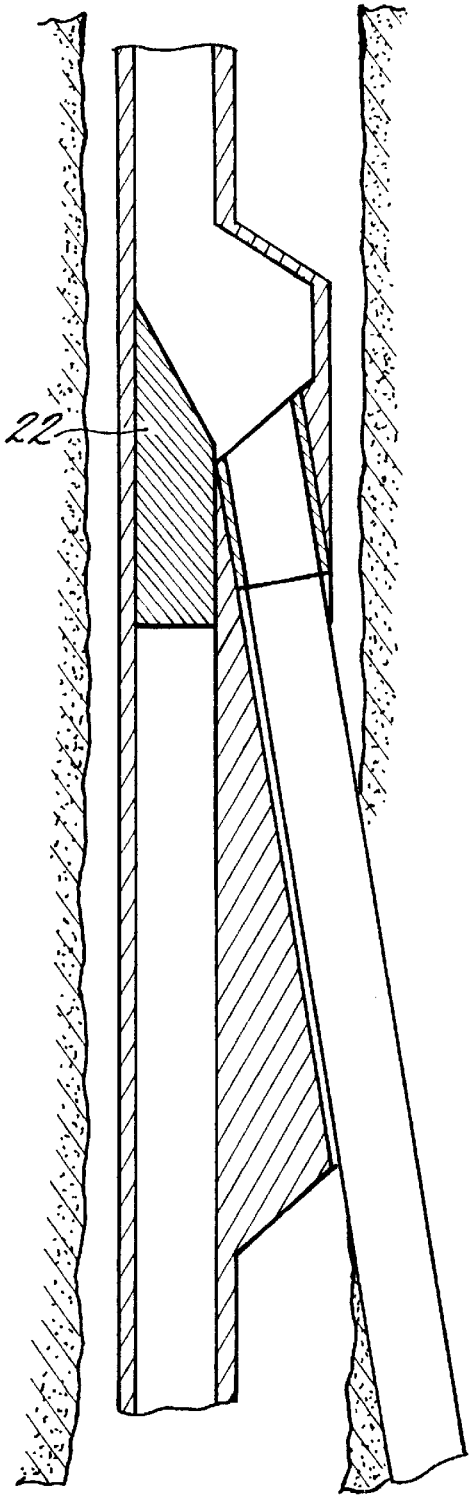
FIG. 2 illustrates, through cross section, the housing after landing and orientation of the whipstock and drilling has been completed.
Figure 3:
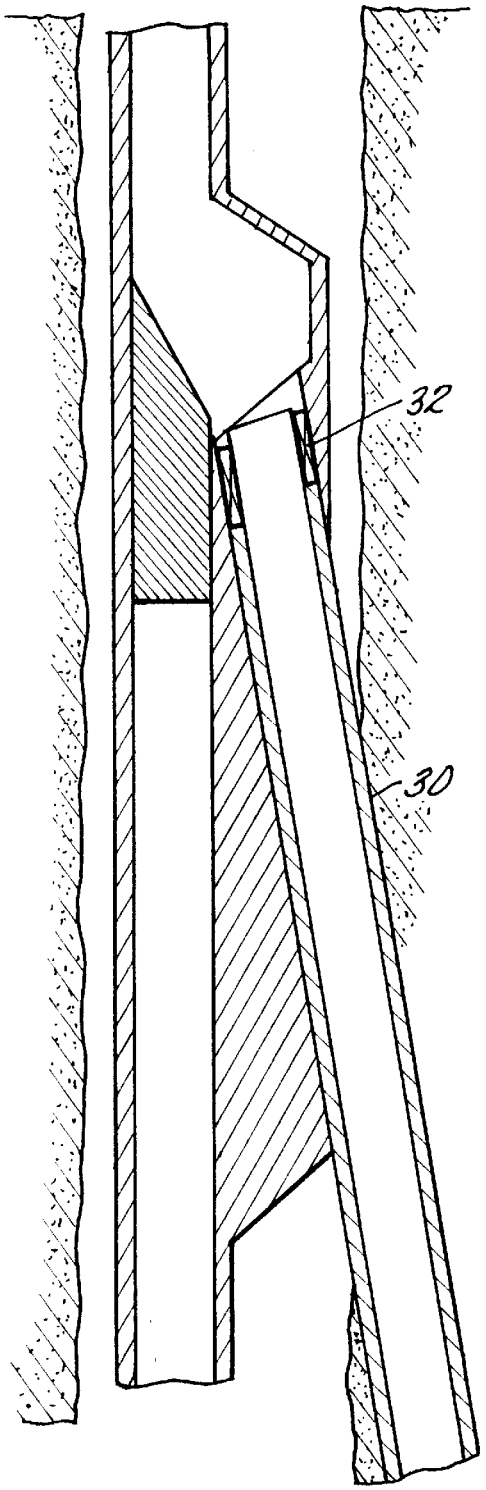
FIG. 3 is a cross section illustration wherein the protective wear bushing has been removed and the lateral liner has been run and sealed against the seal bore.
Figure 4:
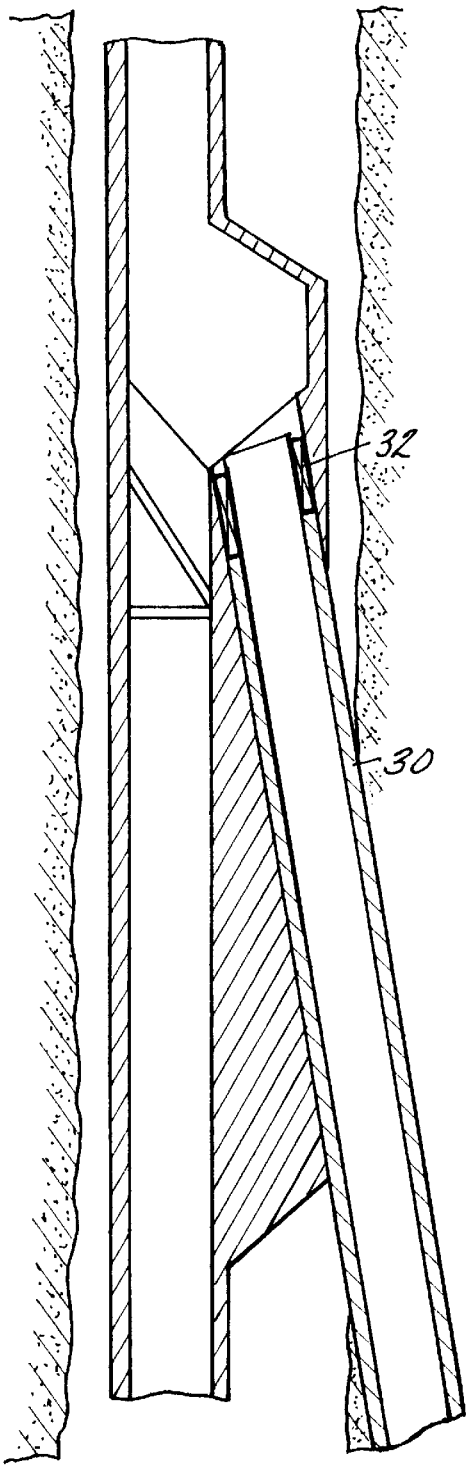
FIG. 4 is a cross section which illustrates the device ready for completion of the lateral.

Housing segment 10 is illustrated in the downhole position having been cemented in place with cement 12 in borehole 14. Section 16 of housing 10 is most preferably 9 ⅝" diameter to allow the passage of conventional tools. It is noted, however, that any desired dimension is possible. It is further noted that downhole section 18 is equal in outer diameter to section 16 and axially aligned therewith to provide easy access to downhole zones in the main borehole. The main section of housing 10 further contains a selective profile 20 to selectively receive, secure and orient a whipstock, visible in FIG. 2 and identified as numeral 22. Housing 10 further includes lateral root 24 extending from a relatively central portion of housing 10 to the O.D. of housing 10 and which bore is plugged with cement 26. Cement 26 extends from the O.D. exit of lateral root 24 uphole until it at least contacts protective wear bushing 28. It is advantageous to leave at least part of wear bushing 28 exposed to the main bore to help properly orient the drill string as it progresses toward the desired lateral. FIG. 2 illustrates the whipstock in position and illustrates the drill string being diverted into the lateral root. Subsequent to the lateral being drilled, a protective wear bushing 28 is removed and a lateral liner 30 is run. The lateral liner 30 is sealed in the lateral root 24 by seal 32 which may be a conventional packing element or other conventional seal. An advantage of the device of the invention is that an ellipsoidal seal is not necessary. Subsequent to sealing the lateral liner 30 whipstock 22 is removed uphole and the well is ready for completion. Preferably a lateral entry tool such as Baker Hughes Part No. 802-15 would be run as part of the completion string to facilitate re-entry to the lateral.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A Multilateral Sealing Device comprising:

a) a casing segment having a primary bore extending therethrough and a secondary bore intersecting the primary bore and extending on an angle thereto;

b) a wear bushing disposed in said secondary bore at at least an uphole section thereof;

c) a removable plug disposed in said secondary bore at at least a downhole portion thereof.

2. A Multilateral Sealing Device as claimed in claim 1 wherein the primary bore further includes a selective profile for supporting a diverter.

3. A Multilateral Sealing Device as claimed in claim 1 wherein said casing provides at least one circular sealing section.

4. A Multilateral Sealing Device as claimed in claim 2 wherein said selective profile orients said diverter in a direction advantageous to direct a drillstring into said secondary bore.

5. A method of sealing junctions in a branched well system comprising:

a) providing a casing segment having a primary bore extending therethrough and a secondary bore intersecting the primary bore and extending on an angle thereto, said secondary bore having a plug therein;

b) positioning said segment in a predetermined location;

c) running a diverter into said segment and into a predetermined position therein to divert a drillstring into said secondary bore;

d) running a drillstring into said secondary bore;

e) drilling out said plug and drilling a lateral borehole coaxially with said secondary bore;

f) installing a liner in said secondary borehole and into said lateral borehole; and g) sealing said liner to said secondary bore.

6. A method as claimed in claim 5 wherein said running of said diverter includes landing of said diverter in a selective profile to orient said diverter in said segment.

7. A method as claimed in claim 5 wherein said sealing said liner into said secondary bore includes placing a packer between said liner and said secondary bore and inflating said packer.

* * * * *